US005359734A

United States Patent [19]

Rathburn

[11] Patent Number: 5,359,734

[45] Date of Patent: Nov. 1, 1994

[54] HAT WITH INTERCHANGEABLE DISPLAY PANELS

[75] Inventor: William H. Rathburn, Ruston, La.

[73] Assignee: The Patch Hat Corp., Dubach, La.

[21] Appl. No.: 71,588

[22] Filed: Jun. 2, 1993

[51] Int. Cl.[5] ..... A42B 1/24

[52] U.S. Cl. ..... 2/195.1; 2/209.13; 2/918; 40/329

[58] Field of Search ..... 2/181, 181.2, 184, 185 R, 2/186, 196, 199, 209.1, 209.3, 209.4; 40/329, 518, 594, 595

[56] References Cited

U.S. PATENT DOCUMENTS

| | | | |
|---|---|---|---|
| 4,667,274 | 5/1987 | Daniel | 2/199 |
| 4,776,043 | 10/1988 | Coleman | 2/199 |
| 5,016,373 | 5/1991 | Theno | 40/594 |
| 5,147,129 | 9/1992 | Ku | 40/329 |

FOREIGN PATENT DOCUMENTS

| | | | |
|---|---|---|---|
| 22180 | 11/1892 | United Kingdom | 40/329 |

*Primary Examiner*—Clifford D. Crowder
*Assistant Examiner*—Diana L. Biefeld
*Attorney, Agent, or Firm*—Gene W. Arant

[57] ABSTRACT

A versatile head gear system includes a hat having a vertical wall in which an opening has been made, and a seam formed about the periphery of the opening; one part of a two-part hook-and-pile type fastening means filling the opening and sewed to the seam; a number of cloth panels each of substantially the same size as the opening and bearing a name, logo, character, or other message on one side thereof; and each of the cloth panels having the other part of the two-part fastening means secured on its other side so that it may be attached to the hat when its particular name, logo, or other message has been selected for display with the hat.

3 Claims, 2 Drawing Sheets

HAT WITH INTERCHANGEABLE DISPLAY PANELS

BACKGROUND OF THE INVENTION

1. Field of the Invention

This invention relates generally to wearing apparel, and more specifically to hats and related headware.

2. Description of the Prior Art

Hats and other headware have become increasingly popular in recent years. In particular, casual baseball style sporting hats are versatile, easily adjustable, and useful for protecting the wearer's eyes from sunlight or rain. Many such hats are decorated with screen printed or embroidered names, logos, characters, special events, or other "message". Another significant reason for the popularity of these hats is that the hats themselves are worn by professional (and not so professional) athletes in many team sports, and fans and supporters of these teams regularly wear caps adorned with their favorite team's name and/or logo. In fact, sales of screen printed and embroidered hats and caps is a big business, both at retail stores and as concession sales at sporting events, entertainment parks, such as Disney World, etc.

SUMMARY OF THE INVENTION

The present invention provides a hat and patch system including a hat having an essentially vertical wall in a portion of which an opening has been made, and having a fastener which is one part of a two-part fastening system filling the opening. A cloth panel is also provided which bears a name, logo, character, or other message on one surface, and on the other surface has a fastener corresponding to the other part of the two-part fastening system. The panel may therefore be secured to the fastener of the hat for displaying the name, logo, character, or other message.

Further according to the invention the fastener is preferably of the hook-and-pile type, and is secured to the wall of the hat around the periphery of the opening.

The present invention allows a person to wear a hat with any selected one of several teams, logos, phrases, names or special events shown on a display panel or patch that has the appearance of being permanently sewn on the hat, while yet owning only a single hat.

DETAILED DESCRIPTION OF A PREFERRED EMBODIMENT

Figure 1:
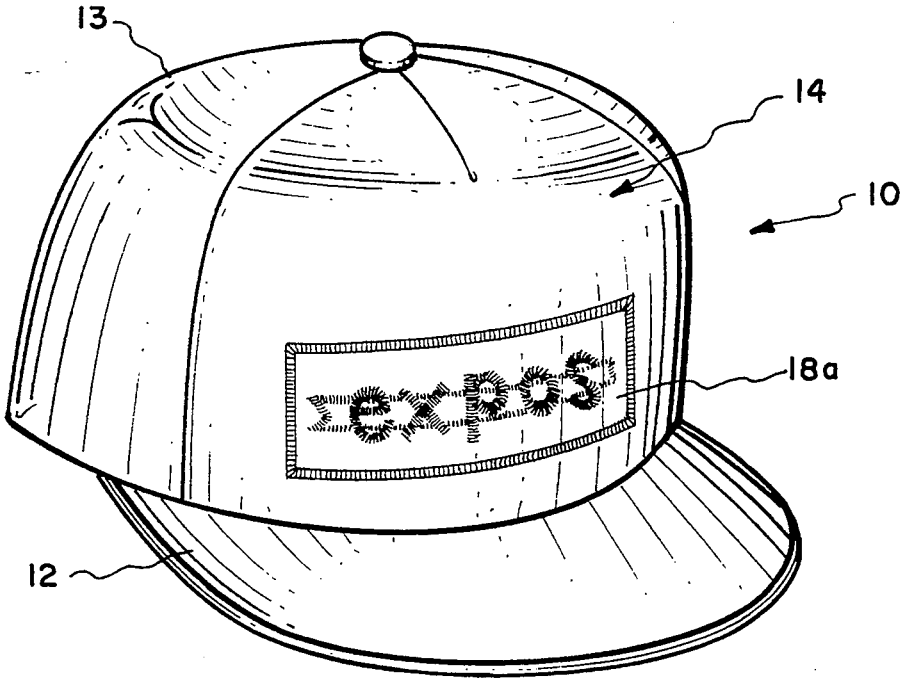
FIG. 1 is a perspective view of a hat in accordance with the invention, bearing an "EXPOS" label.
Figure 2:
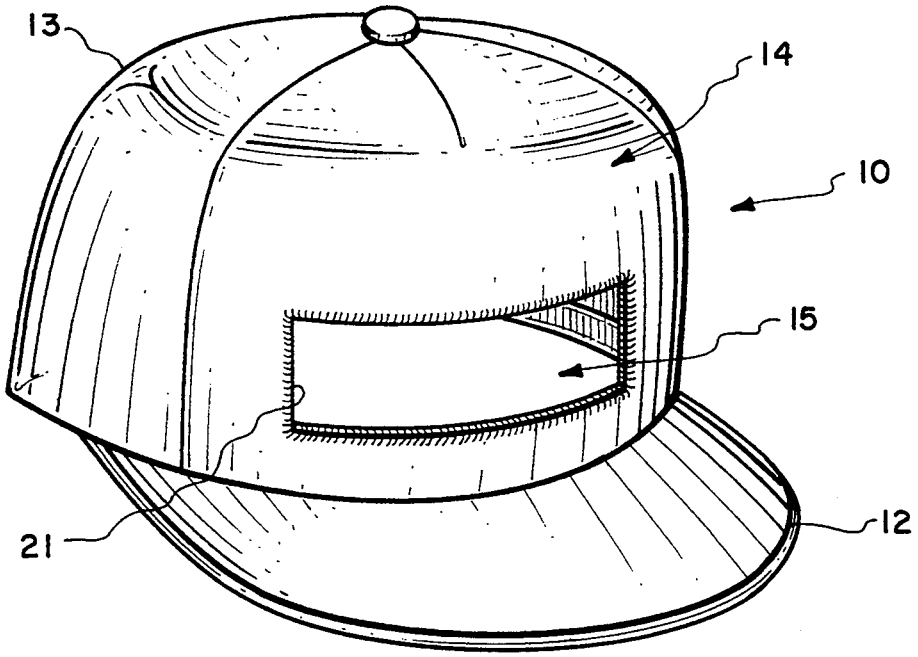
FIG. 2 is a perspective view of the hat showing the opening in the front wall of the hat.

The hat of this invention is illustrated in perspective view in FIG. 2. The hat 10 is preferably a standard, adjustable, billed baseball-style cap made of fabric, plastic or other appropriate material. Hat 10 includes a brim or bill 12, which serves as a shade or visor for the wearer, and a crown top 13. The essentially vertical wall of the hat includes a front wall portion or brow 14 with a cut-out opening 15 which will accommodate a fastening material that will be attached to the inside of the opening. While the opening may be round, elliptical, or some other selected shape, a rectangular shape for the opening will generally be preferred. The border of opening 15 is secured by a seam 21.

Figure 3:
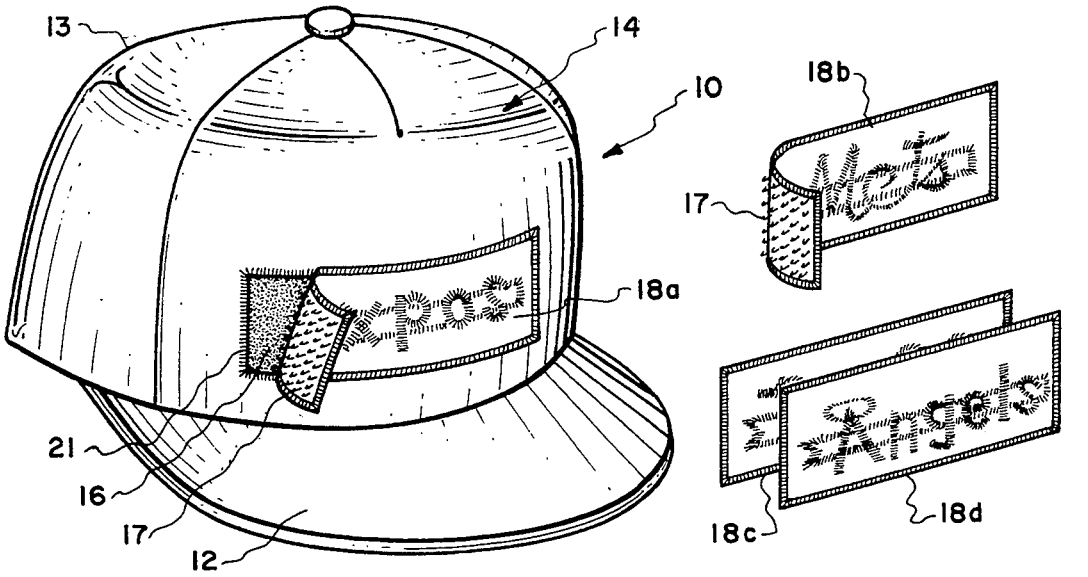
FIG. 3 is an exploded perspective view of the hat showing fastening material secured in the opening of the hat, a patch bearing a logo in accordance with this invention partially secured to the fastening material, and also showing in perspective a plurality of other logo bearing patches in accordance with the invention.

As shown in FIG. 3, the pile part 16 of a two-part type of fastener system of the hook-and-pile type, commonly known as Velcro, is placed within the opening and is secured around the periphery of the opening to the wall portion of the hat. Seam 21 is then reinforced in the process of securing the Velcro.

A plurality of separate patches are provided, each printed with a different phrase or logo, and each with a back surface that is attachable to the fastening material on the hat.

Patch 18*a* is shown being partially secured to the fastening material, revealing the fastening material 16 attached within the opening on the front surface or brow 14. The view of patch 18*a* also reveals the hook portion 17 of the fastener system so that patch 18*a* can be readily attached to or detached from the fastening material 16.

A number of additional patches 18*b*, 18*c* and 18*d* are also provided, each bearing a different phrase or logo to be worn at different times, but with only a single hat.

Figure 4:
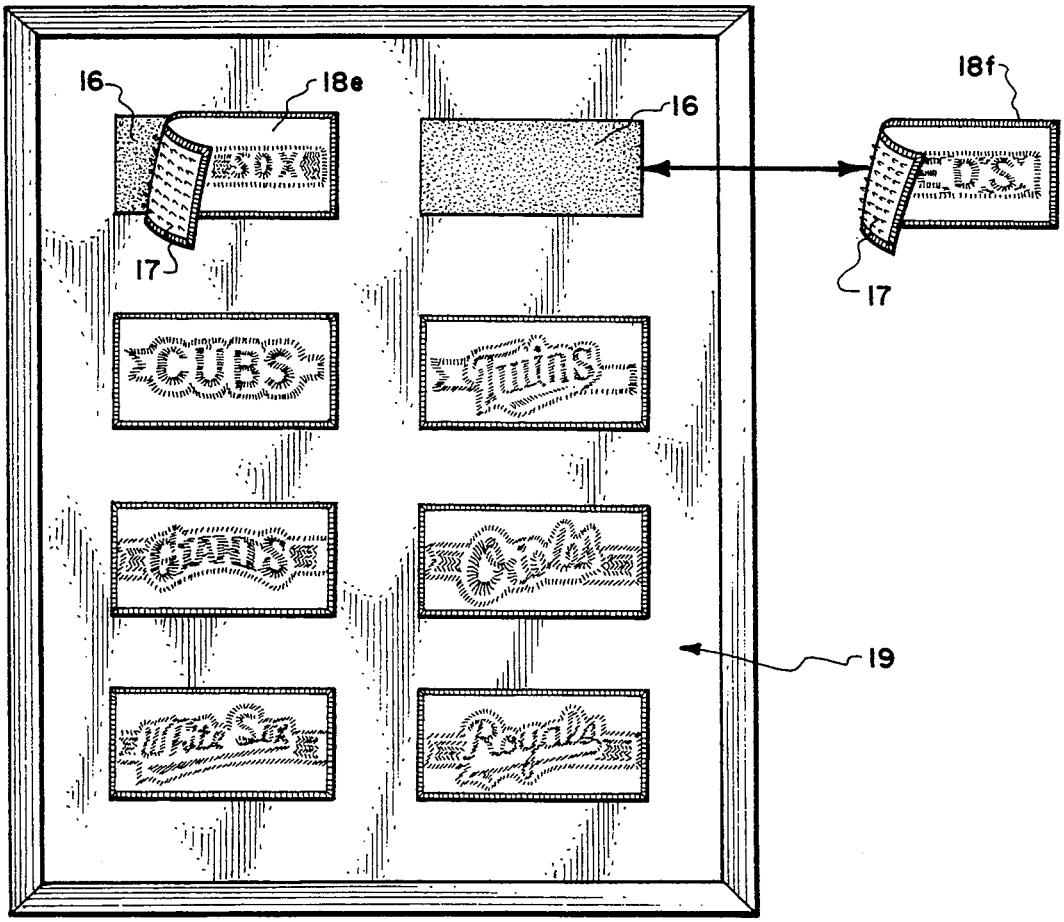
FIG. 4 is a front elevation view of The Patch Hat Board of this invention, illustrating the board with fastening material attached, and a number of patches with different logos, each with a back surface that is attachable to the fastening material.

FIG. 4 is an elevation view of The Patch Hat Board 19 showing how the patches can easily be stored on one board. For example, patch 18*e* is shown being partially removed, while patch 18*f* has been completely removed from the board. The exposed opening on the board bearing no patch has the fastening material pile or "loop" 16 attached to the Board 19. Each of patches 18*e* and 18*f* shows a portion of the hook fastener 17 on its reverse side for attachment of the patches.

The user can select from a variety of high quality patches used on one hat. This reduces the cost of having to buy separate or individual hats with fixed logos or phrases, which would require a large space to accommodate all the hats collected by a consumer. The present invention allows a user to attach his patches to The Patch Hat Board, which is similar to a picture frame and can hold from 4 to 20 or more patches, depending on the size of The Patch Hat Board. The frame comprises a wood or metal frame with compressed cardboard backing with a fastening material attached to the front surface to accommodate the various patches that are attachable to it. A useful application of such "The Patch Hat Board" gives a user the opportunity to store for example phrases or logos on one board for baseball, football, hockey, basketball, golf events, etc., all to be used on one hat.

The potential for The Patch Hat Board is unlimited for the use of very professional sports, also including cartoon characters, names, special events, etc.

The potential for The Patch Hat is to have a quality hat that will affix a patch with a flush look on the surface (brow) that has the appearance of a permanent look.

The hat is a standard baseball-style cap with a hole cut out on the front surface (round, oval, square or rectangular) with a fastening material or adhesive sewn on the inside of the opening of the hat.

While this invention has been described in connection with preferred embodiments thereof, it is obvious that modifications and changes therein may be made by those skilled in the art to which it pertains without departing from the spirit and scope of the invention. Furthermore, any type of fastening means could be employed to attach the patches to the hat, such as snaps, mild adhesives, and the like. Accordingly, the scope of this invention is to be limited only by the appended claims.

What is claimed is:

1. A versatile head gear system comprising:

a hat having an essentially vertical wall in a portion of which an opening has been made, and having a seam formed about the periphery of said opening;

one part of a two-part hook-and-pile fastening means filling said opening and also extending behind said wall portion around the periphery of said opening and secured to the interior surface of said wall portion by sewing said one part to said seam;

a plurality of cloth panels, each of substantially the same size and shape as said opening and each bearing a name, logo, character, or other message on one side thereof; and each of said plurality of cloth panels, on the other side thereof, having secured thereto a fastening means corresponding to the other part of said two-part fastening means, whereby a particular cloth panel bearing one of said name, logo, or other message may be selected for display with said hat, and the other side of the particular cloth panel may then be removably attached to said one part of said two-part fastening means that is accessible through said opening.

2. A versatile head gear system as in claim 1 which further includes a display rack having supported thereon fastening means corresponding to said one part of a two-part fastening means, so that any desired number of said cloth panels may be removably stored thereon.

3. A versatile head gear system as in claim 1 wherein said opening in said hat is essentially rectangular.

* * * * *

UNITED STATES PATENT AND TRADEMARK OFFICE

CERTIFICATE OF CORRECTION

PATENT NO. : 5,359,734
DATED : November 1, 1994
INVENTOR(S) : William H. Rathburn It is certified that error appears in the above-indentified patent and that said Letters Patent is hereby corrected as shown below:

On the title page item [73], delete
The Patch Hat Corporation
Dubach, LA

Signed and Sealed this
Sixth Day of June, 1995

Bruce Lehman

*Attest:*

BRUCE LEHMAN

*Attesting Officer*

*Commissioner of Patents and Trademarks*